US005414395A

United States Patent [19]

Garnto et al.

[11] Patent Number: 5,414,395

[45] Date of Patent: May 9, 1995

[54] ELECTRONIC HOUSING FOR TWO-POLE GROUND FAULT CIRCUIT INTERRUPTER

[75] Inventors: Charles D. Garnto, Tucker; Stephen D. Cella, Stone Mountain, both of Ga.

[73] Assignee: Siemens Energy & Automation, Inc., Alpharetta, Ga.

[21] Appl. No.: 195,634

[22] Filed: Feb. 14, 1994

[51] Int. Cl.[6] ..... H01H 73/00

[52] U.S. Cl. ..... 335/18; 335/132; 335/202

[58] Field of Search ..... 335/8–10, 335/132, 202, 18; 361/42–51

[56] References Cited

U.S. PATENT DOCUMENTS 4,568,899 2/1986 May et al. ..... 335/18
4,609,898 9/1986 Seymour et al. ..... 335/202
5,258,732 11/1993 Marquardt ..... 335/132

*Primary Examiner*—Lincoln Donovan

*Attorney, Agent, or Firm*—Peter A. Luccarelli, Jr.

[57] ABSTRACT

A housing is provided for a circuit breaker. The circuit breaker has contacts capable of being in an open state or a closed state, of movement between the open and closed states, and of generating a hot gas in consequence of that movement. An electronics module is provided for controlling movement of the contacts from the closed state to the open state. The housing has a first portion housing the contacts and a second portion housing the electronics module. The second portion is formed of a material subject to damage by the hot gas, and the first portion is constructed to protect the second portion from damage by the hot gas. The first portion is ideally formed of a thermosetting material resistant to damage by the hot gas and the second portion is ideally formed of a thermoplastic material, which reduces the cost of manufacturing the housing. A quick-mounting construction for assembling the second portion with the first portion further reduces the cost of assembly.

15 Claims, 5 Drawing Sheets

ELECTRONIC HOUSING FOR TWO-POLE GROUND FAULT CIRCUIT INTERRUPTER

CROSS-REFERENCE TO RELATED APPLICATIONS

This application is related to the following copending applications: Applicants Charles D. Garnto; Stephen D. Cella; Harold Louis Taylor, Ser. No. 08/195,635 filed Feb. 14, 1994 for Single Solenoid Actuator for Two-Pole Ground Fault Circuit Interrupter; Applicants Harold Louis Taylor; Elton C. Johnson, Ser. No. 08/189,217 filed Jan. 31, 1994 for Electromagnetic and Radio Frequency Interference Suppression for Ground Fault Circuit Interrupters; Applicants Harold Louis Taylor; Jerry M. Green, Ser. No. 08/189,535 filed Jan. 31, 1994 for Power Supply for Ground Fault Circuit Interrupter.

BACKGROUND OF THE INVENTION

1. Field of the Invention

This invention relates to a housing for a circuit breaker and more particularly to a novel and highly effective housing that is less expensive than conventional circuit breaker housings.

2. Description of the Prior Art

Circuit breakers have contacts capable of being in an open state or a closed state and of movement between the open and closed states. In the closed state they are intended to carry a current. When the current becomes excessive because for example of a short circuit, the circuit breaker is designed to open: i.e., the contacts move to the open state in order to interrupt the current and protect against a fire hazard and other damage that can result from a short circuit. In the case of a ground fault breaker, an imbalance of the current between phase and neutral indicates an alternative path to ground, and this imbalance trips the breaker. The alternative path to ground can be a person. Hence ground fault breakers are "personnel protectors."

When the contacts move in either direction between the open and closed states, arcing results (provided of course that power is supplied to the line side). That is because the contacts neither open nor close instantaneously but rather during a finite period (for example, a few milliseconds). As the contacts approach the closed state or move away from the closed state, there is a brief interval when an electrical current flows through the air gap between the contacts. This current flow through the air gap, called arcing, heats the air or gas in the vicinity of the contacts. The air or gas also contains molten contact material in a plasma state that is conductive.

Modern circuit breakers typically incorporate electronics modules for sensing ground fault conditions and generating a current to actuate solenoids to trip both poles of the circuit breaker in response to detection of a ground fault. Some of these components are susceptible to damage by the heated air that results from arcing. The housing for the circuit breaker should be constructed in such a way that these components are protected from the heated air and from the conductive properties of the plasma, which can bridge traces on the circuit board.

Not only that, but the housing for the circuit breaker must itself be able to withstand the heated air. For this reason, it is necessary to employ a heat-resistant material for the housing. In current practice, this material is normally a thermosetting plastic. Thermosetting materials can withstand the high temperature of the air or gas in the vicinity of circuit breaker contacts that are in the process of opening or closing.

The understanding of those skilled in the art is that thermoplastics, which can be injection molded from inexpensive materials in thin wall sections and using short cycle times, are unsuitable for use in making circuit breaker housings because thermoplastic materials are subject to melting or at least deformation by the gases resulting from arcing at the breaker contacts. Thermosetting materials, in contrast, maintain their shape even under arcing conditions.

However, thermosetting materials have certain disadvantages. One disadvantage is that the molding method employed to form the housing sections is a compression molding method requiring relatively thick wall sections and relatively lengthy cycle times during production. This increases the cost of circuit breaker housings made of thermosetting materials.

Another problem with conventional circuit breaker housings is that it is laborious and expensive to assemble the housing parts.

OBJECTS AND SUMMARY OF THE INVENTION

An object of the invention is to remedy the problems of the prior art noted above. In particular, an object of the invention is to provide a housing for a circuit breaker that can employ inexpensive materials and can have thinner wall sections and be made with shorter cycle times as compared to housings made entirely of thermosetting materials. Another object of the invention is to provide a housing for a circuit breaker that is less expensive to assemble than conventional circuit breaker housings.

The foregoing and other objects are attained in accordance with the invention by providing a housing for a circuit breaker, the circuit breaker having contacts capable of being in an open state or a closed state, of movement between the open and closed states, and of generating a hot gas in consequence of such movement. The circuit breaker also has a control unit for controlling movement of the contacts from the closed state to the open state. The housing comprises a first portion housing the contacts and a second portion housing the control unit. The second portion is formed of a material susceptible to damage by the hot gas, and the first portion is formed of a material resistant to damage by the hot gas and is constructed to protect the second portion from damage by the hot gas.

Preferably, the first portion is formed of a thermosetting material and has a gas port for ejecting the hot gas to the exterior of both the first and second portions; and the second portion is formed of a thermoplastic material.

BRIEF DESCRIPTION OF THE DRAWING

A better understanding of the objects, features and advantages of the invention can be gained from a consideration of the following detailed description of the preferred embodiment thereof, taken in conjunction with the appended figures of the drawing, wherein.

DESCRIPTION OF THE PREFERRED EMBODIMENTS

Figure 6:
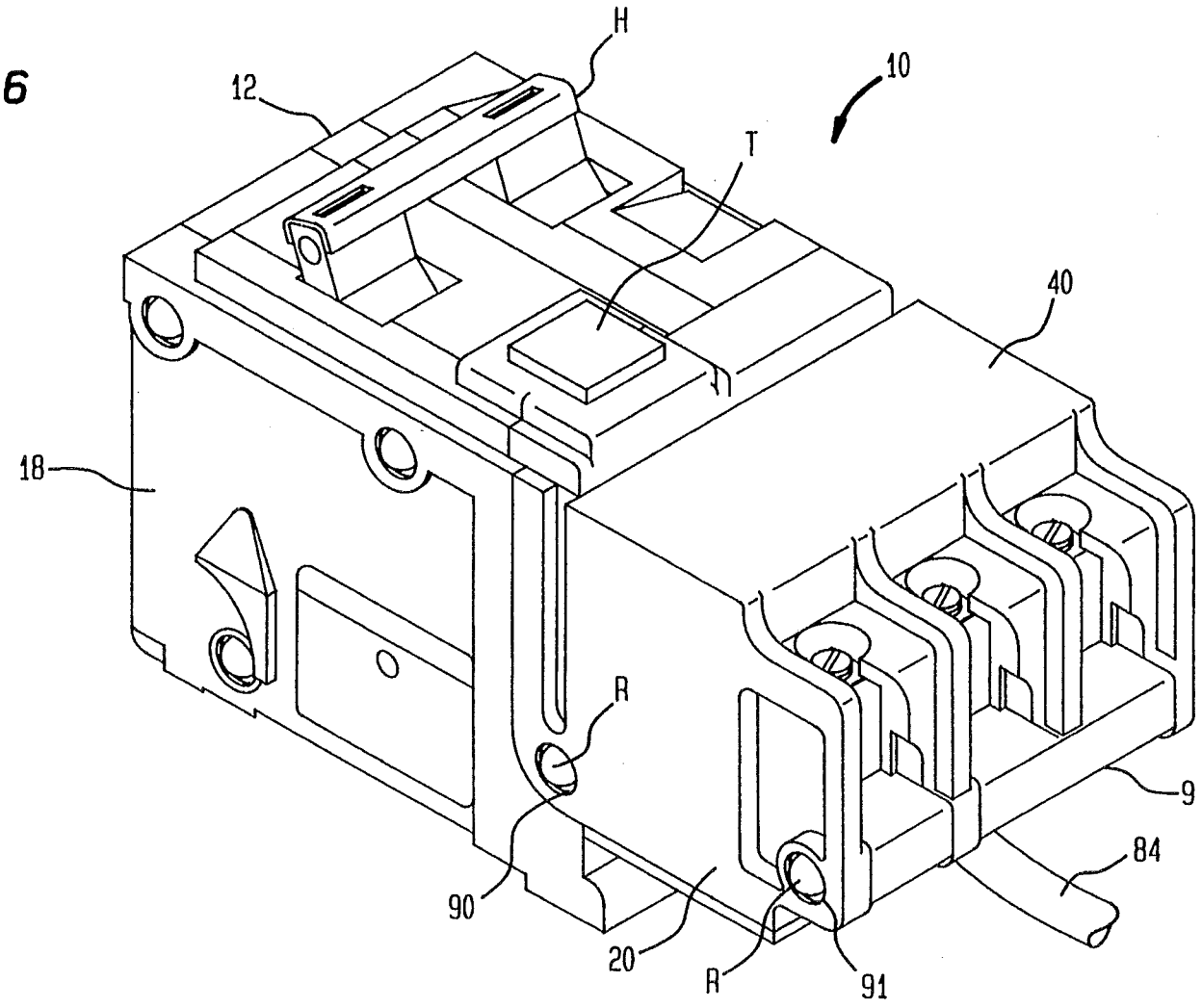
FIG. 6 is a perspective view of the completed assembly.
Figure 7:
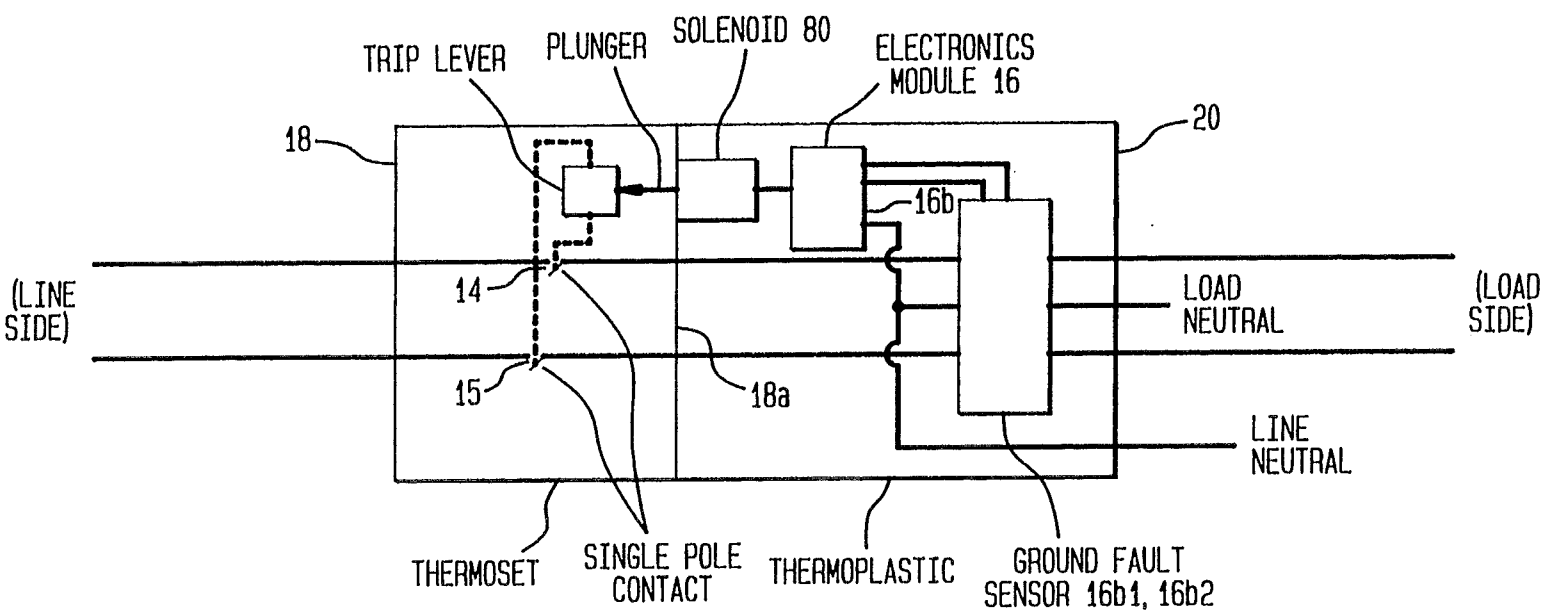
FIG. 7 is a schematic drawing of the electrical circuitry accommodated by the housing.

FIG. 6 shows an assembled housing 10 for a circuit breaker 12 shown schematically in FIG. 7. As FIG. 7 shows, the circuit breaker 12 has contacts 14, 15 capable of being in an open state or a closed state, of movement between the open and closed states, and, as explained above, of generating a hot gas in consequence of such movement. A control unit including an electronics module 16 formed with one or more current sensors **16*a* and a circuit board 16*b* controls movement of the contacts 14, 15** from the closed state to the open state.

The housing 10 comprises a first portion 18 housing the contacts 14, 15 and a second portion 20 housing the electronics module 16. In accordance with the invention, the second portion 20 is formed of a material, preferably a thermoplastic material, which is susceptible to damage by the hot gas but has the advantage of being inexpensive. The first portion 18 is formed of a material, preferably a thermosetting material, resistant to the hot gas and, as explained below, is constructed to protect the second portion 20 from damage by the hot gas. The common wall **18*a* between the first portion 18 and the second portion 20** is formed of a thermosetting material.

It is of course within the scope of the invention to employ for the first portion 18 a material other than a thermosetting material—a ceramic for example—, so long as it adequately resists damage by the hot gas; and to employ for the second portion 20 an inexpensive material other than a thermoplastic material in order to reduce the total cost of the housing.

Figure 1:
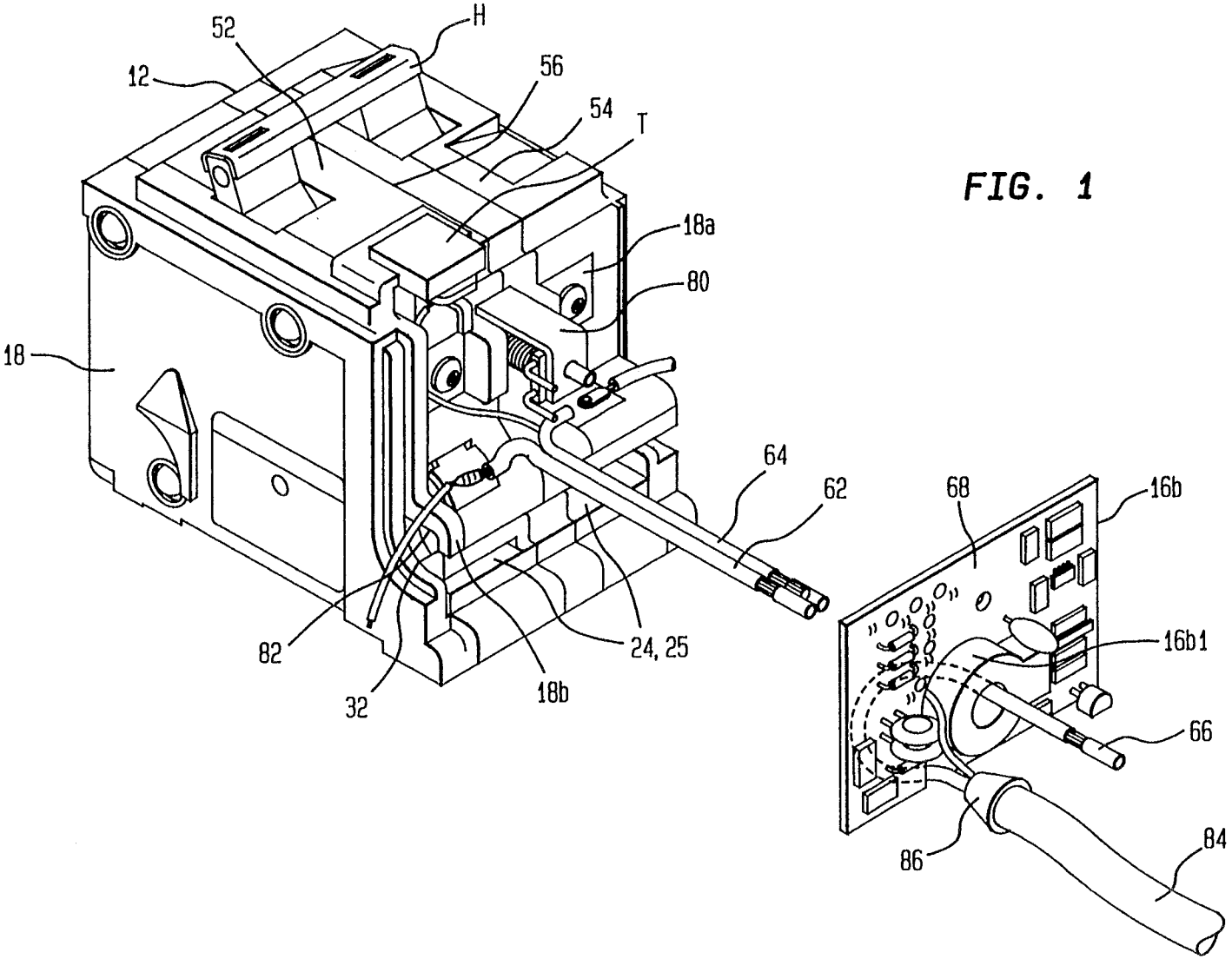
FIG. 1 is an exploded perspective view of a portion of a housing constructed in accordance with the invention and certain components accommodated by the housing.

As FIG. 1 best shows, the first portion 18 is formed with one or more gas ports 24, 25 for ejecting the hot gas to the exterior of the first portion 18. As FIGS. 3, 4 and 6, discussed in detail below, show, the second portion 20 connects with the first portion 18 above the gas ports 24, 25, so that the gas ejected through those ports is exterior not only to the first portion 18 but also to the second portion 20. While the gas ports 24, 25 are illustrated on what may be regarded as the rear wall **18*a* of the first portion 18, their location is not critical; they can be positioned, for example, on the bottom wall and/or one or both side walls. The important function performed by the gas ports 24, 25 is to provide for safe exit of the expanding hot gas to the exterior of both the first portion 18 and the second portion 20 of the housing 10. Since the first portion 18 is formed for example of a thermosetting material, it can withstand the hot gas. The second portion 20, which is preferably made of a thermoplastic material and cannot withstand exposure to the gas until after it has cooled, is protected by the construction against the deformation or melting that would result if it came into immediate contact with the hot gas in the vicinity of the contacts 14, 15**.

The first housing portion 18 is formed with a hinge 28 formed by a raised rib 30 and a groove 32 each extending left-to-right across the width of the first portion 18 near the bottom. A bottom piece 34, when held in a first position (FIG. 3) inclined about 45° to the horizontal, is engageable by virtue of a hook 36 with the hinge 28. The bottom piece 34 forms the bottom of the second portion 20 and is pivotable about the hinge 28 to a second position, illustrated in FIG. 4 as horizontal. Of course, the term "horizontal" is a term relative to the housing 10; the housing 10 may assume any orientation whatsoever with respect to the horizontal plane of the ground.

Figure 4:
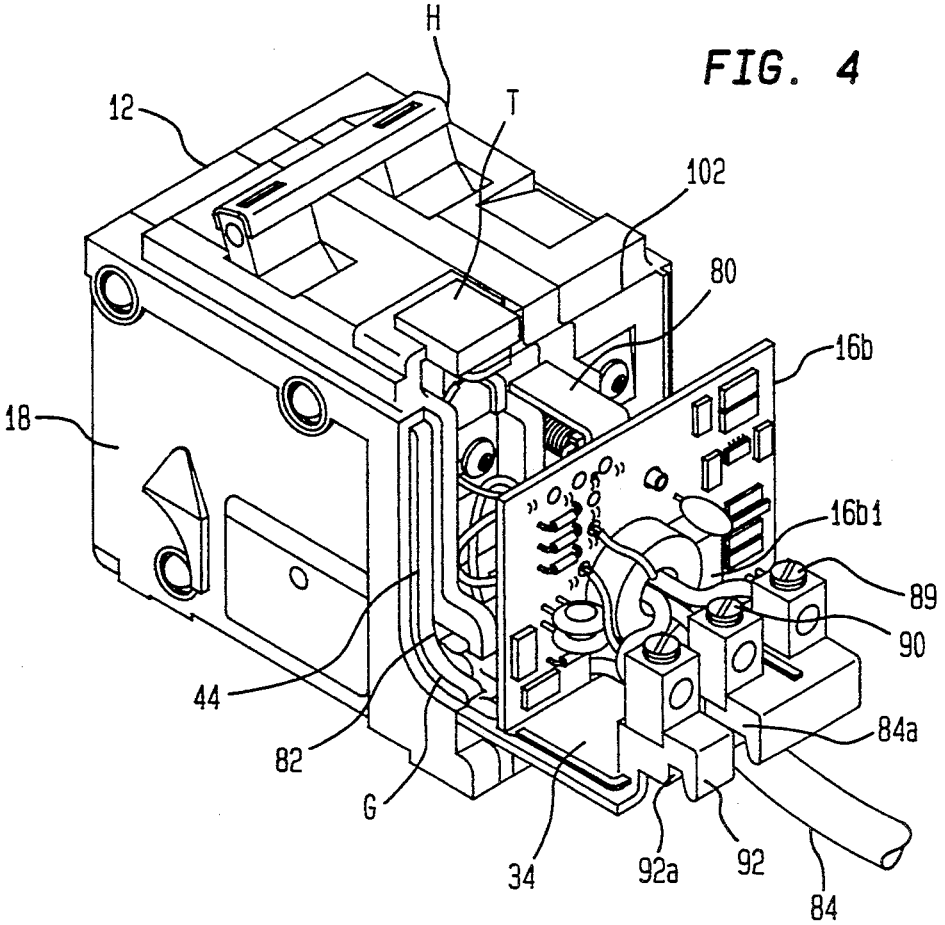
FIG. 4 is a view similar to FIG. 3 showing the bottom piece moved into its final position.
Figure 5:
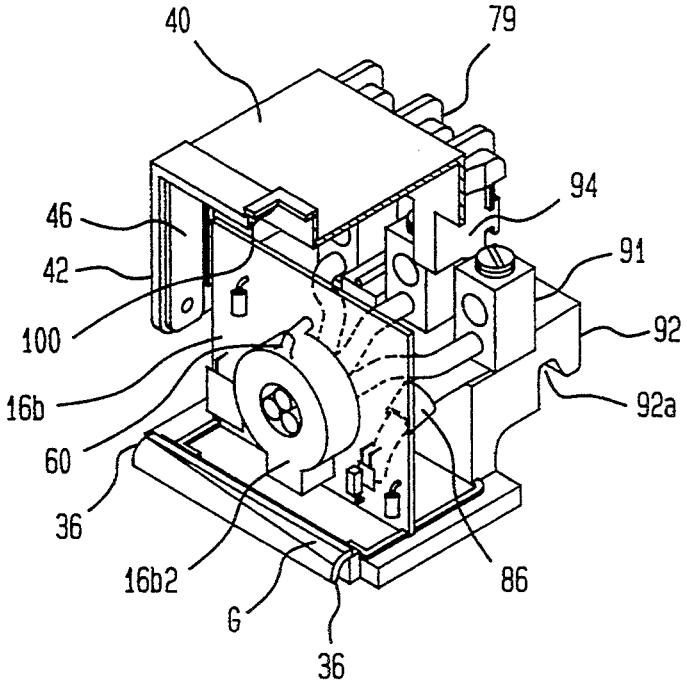
FIG. 5 is a view similar to FIG. 4 but from the opposite side showing in exploded form the addition of a shroud to the bottom piece, the first portion of the housing being omitted for clarity.

When the bottom piece 34 is in the second position illustrated in FIG. 4, a shroud 40 illustrated in FIGS. 5 and 6 is engageable with the bottom piece 34. The shroud 40, which forms the top of the second portion 20, slides down from the top and has contoured edges 42 that match contoured edges 44 on the first housing portion 18. Thereupon, lip 100, formed in the shroud 40, interlocks with trough 102, which is formed in the first housing portion 18. A wide rib 46 helps to maintain proper alignment. A pair of narrower ribs (not illustrated) slide down on opposite sides of the circuit board **16*b* forming a part of the electronics module 16** and help to position it.

The circuit breaker 12 has a pair of breaker poles 52, 54 symmetrically arranged with respect to a centerline 56, and the electronics module 16 comprises a pair of annular current sensors 16b1 (FIGS. 1–4) and 16b2 (FIG. 5) surrounding electrical leads 62, 64 that carry phase current of the circuit breaker 12 and neutral lead 66 that carries neutral current through sensors 16b1, 16b2. In accordance with the invention, structure such as the circuit board **16*b* is employed for mounting the annular current sensors 16b1, 16b2 on the centerline 56**.

FIG. 1 shows a solenoid 80 mounted in position. The wires 62, 64 from each phase of the circuit breaker extend from a position above a barrier 82. The neutral wire assembly 84 is attached to the circuit board **16*b*, with neutral lead 66** passing through the sensor.

Figure 2:
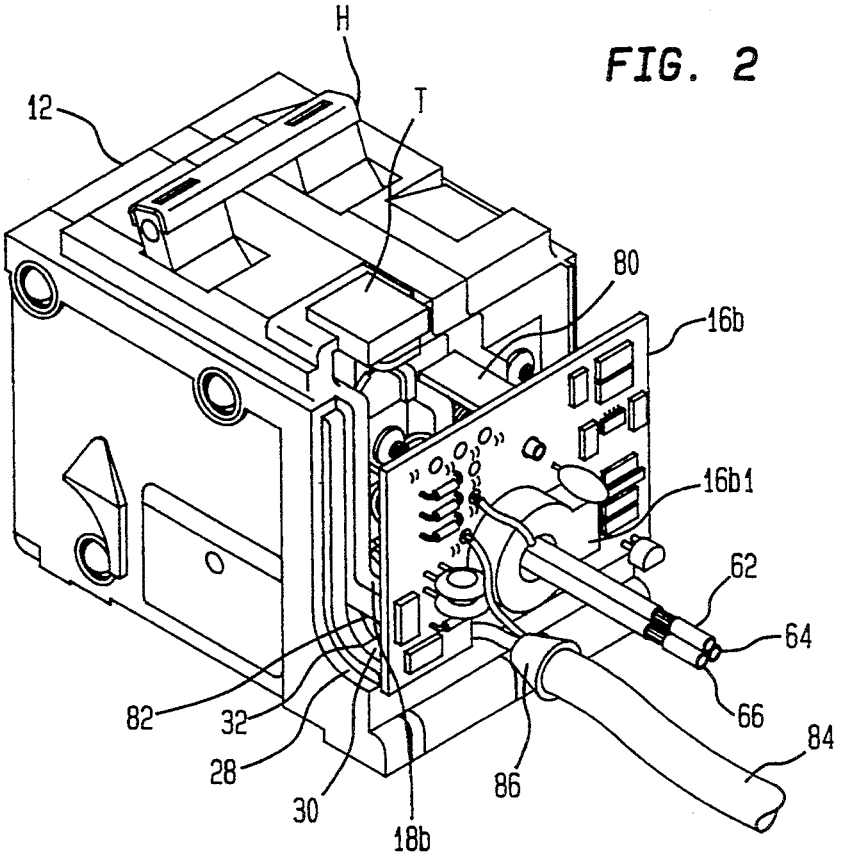
FIG. 2 is a view similar to FIG. 1 showing the assembly of the parts of FIG. 1.

FIG. 2 shows the circuit board **16*b* assembled with the breaker poles with all connections soldered. It also shows the hinge 28 defined by the rib 30 and groove 32**.

Figure 3:
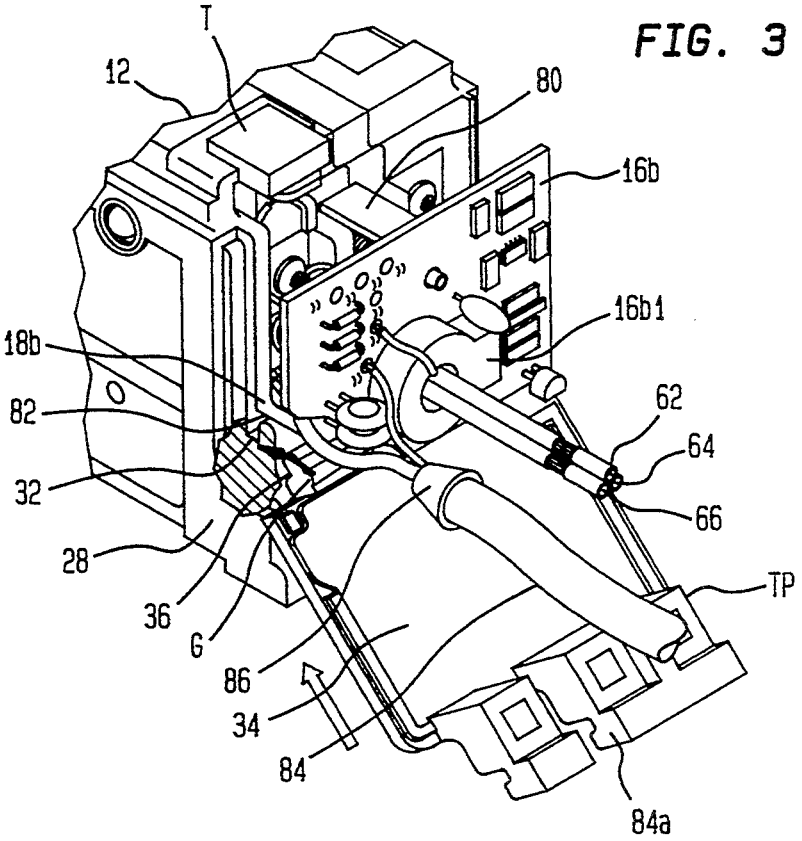
FIG. 3 is a fragmentary view similar to FIG. 2 showing the addition of a bottom piece of another portion of the housing.

FIG. 3 shows the hook 36 on the bottom piece 34 engaged with the hinge 28.

FIG. 4 shows the bottom piece 34 rotated into its final position and the wire connectors 89, 90, 91 attached to the wires 62, 64, 66 that are better shown in FIG. 3. The neutral wire 84 slides through a trough **84*a* in the bottom piece 34. A crimp connector 86 abuts a wall defining the trough 84*a* in the bottom piece 34**.

FIG. 5 shows the shroud 40 being slid over the circuit board. The breaker pole is removed in this view so that the interface with the circuit board is visible. A front rivet R is installed through a front hole 90 in the shroud 40 along a guide G on the bottom piece, which forces the hook 36 into the lower groove 32 of the breaker pole. The rivet extends all the way thought the shroud 40. A protrusion **18*b* from the wall 18*a* of the first housing portion 18 prevents the hook 36 from coming out of position. The groove 32 and protrusion 18*b* are visible in FIGS. 2 and 3. A rear rivet R is installed through a rear hole 91 in the shroud and passes along a groove 92*a* under a hook 92 formed on the bottom 34. When the rear rivet is installed (again, all the way thorough from left to right), a downward projection 94 on the shroud 40 clamps the neutral wire 84. The rivets R are shown in FIG. 6**.

The complete assembly (FIG. 6) forms a compact and efficient unit. It overcomes the problems of the prior art and accomplishes the objects of the invention as set out above. In particular, the housing can employ inexpensive materials and can have thinner wall sections and be made with shorter cycle times as compared to a housing made entirely of relatively expensive materials such as thermosetting materials. The housing is less expensive to manufacture than conventional housings not only because of the use of less expensive materials but also because the design is such that the parts can be manufactured more quickly and can be assembled more quickly. In particular, the design is such that side cores are required in making only one of the bottom piece and shroud. Thus the bottom can be molded without pulling any cores in the mold. This further reduces the cost of manufacture. The position of the sensors on the centerline of the breaker poles makes it easier to get the wires from each pole to enter and exit the sensors symmetrically. The same length of wire is used for each pole, which reduces the effects of electrical load shifting. For all of these reasons, the invention represents a substantial improvement in the art.

A conventional test button T and reset handle H are provided, as those skilled in the art will readily understand. Other features disclosed in the drawings but not essential to an understanding of the present invention are described in greater detail in the copending related applications listed above.

Many modifications of the preferred embodiment of the invention disclosed above will readily occur to those skilled in the art. For example, materials other than thermosetting materials for the first portion and the thermoplastic materials for the second portion of the housing can be employed. Also, other structure for assembling the second housing portion 20 to the first housing portion 18 can be employed, as those skilled in the art will readily understand. In addition, the use of thermoplastic material makes it possible to employ a design utilizing snap fits and not requiring the use of rivets. Accordingly, the invention is to be construed as including all subject matter that falls within the scope of the appended claims, and equivalents thereof.

We claim:

1. A housing for a circuit breaker, said circuit breaker having:

contacts capable of being in an open state or a closed state, of movement between said open and closed states, and of generating a hot gas in consequence of said movement, and a control unit for controlling movement of said contacts from said closed state to said open state, and said housing comprising:

a first portion housing said contacts; and a second portion housing said control unit;

each of said first and second housing portions having one of an elongated, interlocking hook and groove on adjoining respective faces thereof, which define an axis and wherein said interlocking hook and groove prevent separation of said housing portions in directions generally perpendicular to said axis.

2. A housing according to claim 1 wherein said first portion is formed of a thermosetting material.

3. A housing according to claim 1 wherein said second portion is formed of a thermoplastic material.

4. A housing according to claim 1 wherein said first portion is formed with a gas port proximal said one of elongated hook and groove for ejecting said hot gas to the exterior of both said first and second portions.

5. A housing according to claim 1 wherein said first portion is formed with said elongated groove and said second portion comprises a bottom piece having said elongated hook which interlocks within said elongated groove engageable in a first position with said groove and pivotable about said groove to a second position and a shroud engageable with said bottom piece when said bottom piece is in said second position.

6. A housing according to claim 1 wherein said circuit breaker has a pair of breaker poles symmetrically arranged with respect to a centerline and said control unit comprises at least one annular current sensor surrounding electrical leads that carry power to said circuit breaker, further comprising structure mounting said annular current sensor on said centerline.

7. A housing according to claim 1 wherein said control unit comprises an electronics module.

8. A housing for a circuit breaker, said circuit breaker having:

contacts capable of being in an open state or a closed state, of movement between said open and closed states, and of generating a hot gas in consequence of said movement, and an electronics module for controlling movement of said contacts from said closed state to said open state, and said housing comprising:

a first portion housing said contacts and having an adjoining face; and a second portion housing said electronics module and having an adjoining face;

said second portion being formed of a thermoplastic material susceptible to damage by said hot gas and said first portion being formed of a thermosetting material and constructed to protect said second portion from damage by said hot gas and having an elongated, interlocking hook on said respective adjoining face thereof which defines an axis;

said first portion being formed with a gas port for ejecting said hot gas to the exterior of both said first and second portions and having an interlocking groove on said respective adjoining face thereof, and wherein said interlocking hook and groove prevent separation of said housing portions generally perpendicular to said axis;

said second portion comprising a bottom piece having said hook engageable in a first position with said groove and pivotable about said groove to a second position and a shroud engageable with said bottom piece when said bottom piece is in said second position;

wherein said circuit breaker has a pair of breaker poles schematically arranged with respect to a centerline, said electronics module comprising an annular sensor surrounding electrical leads that carry power to said circuit breaker;

further comprising structure mounting said annular current sensor on said centerline.

9. The housing according to claim 1, wherein at least one of said hook and groove defines a ramped portion oriented along said axis.

10. The housing according to claim 5, wherein said shroud and said first housing portion have a respective interlocking lip and trough thereon.

11. The housing according to claim 5, wherein said shroud has at least one aperture and said bottom piece has a second hook defining a second groove therein for passage of a fastener through said shroud aperture and said second groove.

12. A housing for a circuit breaker, said circuit breaker having:

contacts capable of being in an open state or a closed state, of movement between said open and closed states, and of generating a hot gas in consequence of said movement, and a control unit for controlling movement of said contacts from said closed state to said open state, and said housing comprising:

a first portion housing said contacts, having an elongated groove which defines an axis; and a second portion housing said control unit, including a bottom piece having an elongated hook which interlocks within said groove, and enables cantilever projection of said bottom piece from said first portion generally perpendicular with respect to the axis, and a shroud engageable with said bottom piece.

13. The housing according to claim 12, wherein at least one of said hook and groove defines a ramped portion oriented along said axis.

14. The housing according to claim 12, wherein said shroud and said first housing portion have a respective interlocking lip and trough thereon.

15. The housing according to claim 12, wherein said shroud has at least one aperture and said bottom piece has a second hook defining a second groove therein for passage of a fastener through said shroud aperture and said second groove.

* * * * *